US007364184B2

(12) United States Patent
Delhotal

(10) Patent No.: US 7,364,184 B2
(45) Date of Patent: Apr. 29, 2008

(54) MOBILITY ASSIST DEVICES

(76) Inventor: Pam Delhotal, 303 Brookside Dr., Ft. Mill, SC (US) 39715

( * ) Notice: Subject to any disclaimer, the term of this patent is extended or adjusted under 35 U.S.C. 154(b) by 8 days.

(21) Appl. No.: 11/437,019

(22) Filed: May 18, 2006

(65) Prior Publication Data

US 2006/0261569 A1 Nov. 23, 2006

Related U.S. Application Data

(60) Provisional application No. 60/699,966, filed on Jul. 15, 2005, provisional application No. 60/682,086, filed on May 18, 2005.

(51) Int. Cl.
*A61G 5/00* (2006.01)

(52) U.S. Cl. ..... 280/643; 280/648; 280/47.4

(58) Field of Classification Search ..... 280/7.1, 280/30, 47.1, 87.021, 643, 648, 47.4; 135/66, 135/67; 108/50.16; 297/5
See application file for complete search history.

(56) References Cited

U.S. PATENT DOCUMENTS 2,362,186 A * 11/1944 Brantz ..... 280/650
2,595,055 A * 5/1952 Thomas ..... 280/304.1
3,237,940 A * 3/1966 Johnson ..... 482/68
4,453,732 A * 6/1984 Assanah et al. ..... 280/648
5,050,899 A * 9/1991 Stensby ..... 280/250.1
5,333,887 A * 8/1994 Luther ..... 280/250.1
6,595,474 B2 * 7/2003 Nicholson ..... 248/118
6,792,633 B1 * 9/2004 Ito ..... 5/618

* cited by examiner

*Primary Examiner*—Christopher Ellis
*Assistant Examiner*—Katy Meyer
(74) *Attorney, Agent, or Firm*—Clements Bernard Miller; Christopher L. Bernard; Seth L. Hudson

(57) ABSTRACT

Mobility assist devices for moving an individual with limited mobility, or allowing such an individual to move himself or herself, include: a substantially-rigid frame or body assembly having sufficient strength to support the weight of the individual; a plurality of lockable/brakeable rolling members attached to the substantially-rigid frame or body assembly; and a seat member attached to the substantially-rigid frame or body assembly, wherein the seat member includes a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device.

24 Claims, 18 Drawing Sheets

MOBILITY ASSIST DEVICES

CROSS-REFERENCE TO RELATED APPLICATION(S)

The present non-provisional patent application claims the benefit of priority of U.S. Provisional Patent Application No. 60/682,086, filed on May 18, 2005, and entitled MOBILITY ASSIST DEVICES, and U.S. Provisional Patent Application No. 60/699,966, filed on Jul. 15, 2005, and entitled MOBILITY ASSIST DEVICES, the contents of which are incorporated in-full by reference herein.

FIELD OF THE INVENTION

The present invention relates generally to the healthcare field. More specifically, the present invention relates to a plurality of mobility assist devices that are designed and configured to assist a healthcare provider in selectively moving an individual under his or her care, as well as assisting the individual in moving himself or herself.

BACKGROUND OF THE INVENTION

It is often necessary for a healthcare provider to physically move an individual under his or her care, such as into and/or out of a bed, chair, or the like; into and/or out of a vehicle; across a room; from room to room; etc. Typically, this individual has limited mobility. This requires the healthcare provider to use a great deal of effort and expend a great deal of energy, often leading to back problems, muscle strains, fatigue, etc. It is also often necessary for an individual to move himself or herself, which represents a challenge to one with limited mobility.

Thus, what are needed are a plurality of mobility assist devices that are designed and configured to assist the healthcare provider in moving the individual under his or her care, as well as assisting the individual in moving himself or herself.

BRIEF SUMMARY OF THE INVENTION

Broadly, the present invention provides a plurality of mobility assist devices that are designed and configured to assist a healthcare provider in moving an individual under his or her care, as well as assisting the individual in moving him or herself. The mobility assist devices of the present invention comprise a transfer scooter; a lift system for individuals with sufficient strength to use the lift system to adjust their position in bed or the like, move from bed or the like into a wheelchair or the like, etc.; a pull-up assembly that facilitates the movement of an individual in bed or the like by the healthcare provider; and a mobility assist strap that can be utilized with the lift system and the pull-up assembly to assist the healthcare provider in moving the individual under his or her care.

The transfer scooter is embodied in at least four conceptual variations that incorporate the inventive elements of the transfer scooter: a glider-type transfer scooter; a walker-type transfer scooter; a motorized transfer scooter; and a non-motorized transfer scooter. The transfer scooter matches the inherent mobility of the user with the application of the mobility assist device. For example, in addition to providing assistance and transportation, the transfer scooter provides various levels of support and exercise. In general, the transfer scooter includes a frame, a seat, a deployable ramp to facilitate loading/unloading, a plurality of wheels, and an armrest that is optionally padded.

In one specific embodiment of the present invention, a mobility assist device for moving an individual with limited mobility, or allowing such an individual to move himself or herself, comprises: a substantially-rigid frame having sufficient strength to support the weight of the individual; a plurality of lockable/brakeable rolling members attached to the substantially-rigid frame; and a seat member attached to the substantially-rigid frame, wherein the seat member comprises a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device. Furthermore, the seat and/or the deployable seat back member can be retractable, either slidably translatable or in an overlapping configuration.

In another specific embodiment of the present invention, a mobility assist device for moving an individual with limited mobility, or allowing such an individual to move himself or herself, comprises: a substantially-rigid body assembly having sufficient strength to support the weight of the individual, wherein the substantially-rigid body assembly is one of motorized and non-motorized; a plurality of lockable/brakeable rolling members attached to the substantially-rigid body assembly; and a seat member attached to the substantially-rigid body-assembly, wherein the seat member comprises a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device.

In a further specific embodiment of the present invention, a mobility assist device for moving an individual with limited mobility, or allowing such an individual to move himself or herself, comprises: a substantially-rigid body assembly having sufficient strength to support the weight of the individual, wherein the substantially-rigid body assembly is one of motorized and non-motorized; a plurality of lockable/brakeable rolling members attached to the substantially-rigid body assembly; and a translatable seat member attached to the substantially-rigid body-assembly, wherein the translatable seat member comprises a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device.

The lift system includes a rigid frame including a plurality of legs surrounding the bed of a user, the rigid frame operable for selectively bearing the weight of and supporting the user. The lift system also includes a translatable transfer bar movably attached to the rigid frame and a translatable assist member movably attached to the translatable transfer bar.

The pull-up assembly includes a low-friction transfer board that is selectively disposed on the bed of a user, under the back of the user, and a winch assembly attached to the low-friction transfer board via a transfer line, the winch assembly selectively actuated to move the low-friction transfer board and the user relative to the bed of the user.

The mobility assist strap includes a user harness including a plurality of padded shoulder straps, a plurality of quick-release attachment points coupled to the plurality of padded shoulder straps, a back brace coupled to the plurality of padded shoulder straps, and one or more spanning straps selectively coupled to one or more of the plurality of quick-release attachment points coupled to the plurality of shoulder straps, the one or more spanning straps operable for supporting an object to be moved.

BRIEF DESCRIPTION OF THE DRAWINGS

The present invention is illustrated and described herein with reference to the various drawings, in which like references denote like components and/or parts, as appropriate, and in which:

FIG. 3 is a perspective view of the glider-type transfer scooter of FIGS. 1 and 2, wherein the deployable seat back is reclined, thereby being operable as a ramp for moving to and from a bed, chair, vehicle passenger compartment, or the like;

FIG. 6 is a perspective view of the walker-type transfer scooter of FIG. 5, wherein the deployable seat back is reclined, thereby being operable as a ramp for moving to and from a bed, chair, vehicle passenger compartment, or the like;

DETAILED DESCRIPTION OF THE INVENTION

Broadly, the present invention provides a plurality of mobility assist devices that are designed and configured to assist a healthcare provider in moving an individual under his or her care, as well as assisting the individual in moving him or herself. The mobility assist devices of the present invention comprise a transfer scooter; a lift system for individuals with sufficient strength to use the lift system to adjust their position in bed or the like, move from bed or the like into a wheelchair or the like, etc.; a pull-up assembly that facilitates the movement of an individual in bed or the like by the healthcare provider; and a mobility assist strap that can be utilized with the lift system and the pull-up assembly to assist the healthcare provider in moving the individual under his or her care.

The transfer scooter is embodied in at least four conceptual variations that incorporate the inventive elements of the transfer scooter: a glider-type transfer scooter; a walker-type transfer scooter; a motorized transfer scooter; and a non-motorized transfer scooter. The transfer scooter matches the inherent mobility of the user with the application of the mobility assist device. For example, in addition to providing assistance and transportation, the transfer scooter provides various levels of support and exercise. In general, the transfer scooter includes a frame, a seat, a deployable ramp to facilitate loading/unloading, a plurality of wheels, and an armrest that is optionally padded. The transfer scooter is appropriately sized to accommodate the user's size, and particular physical needs.

Figure 1:
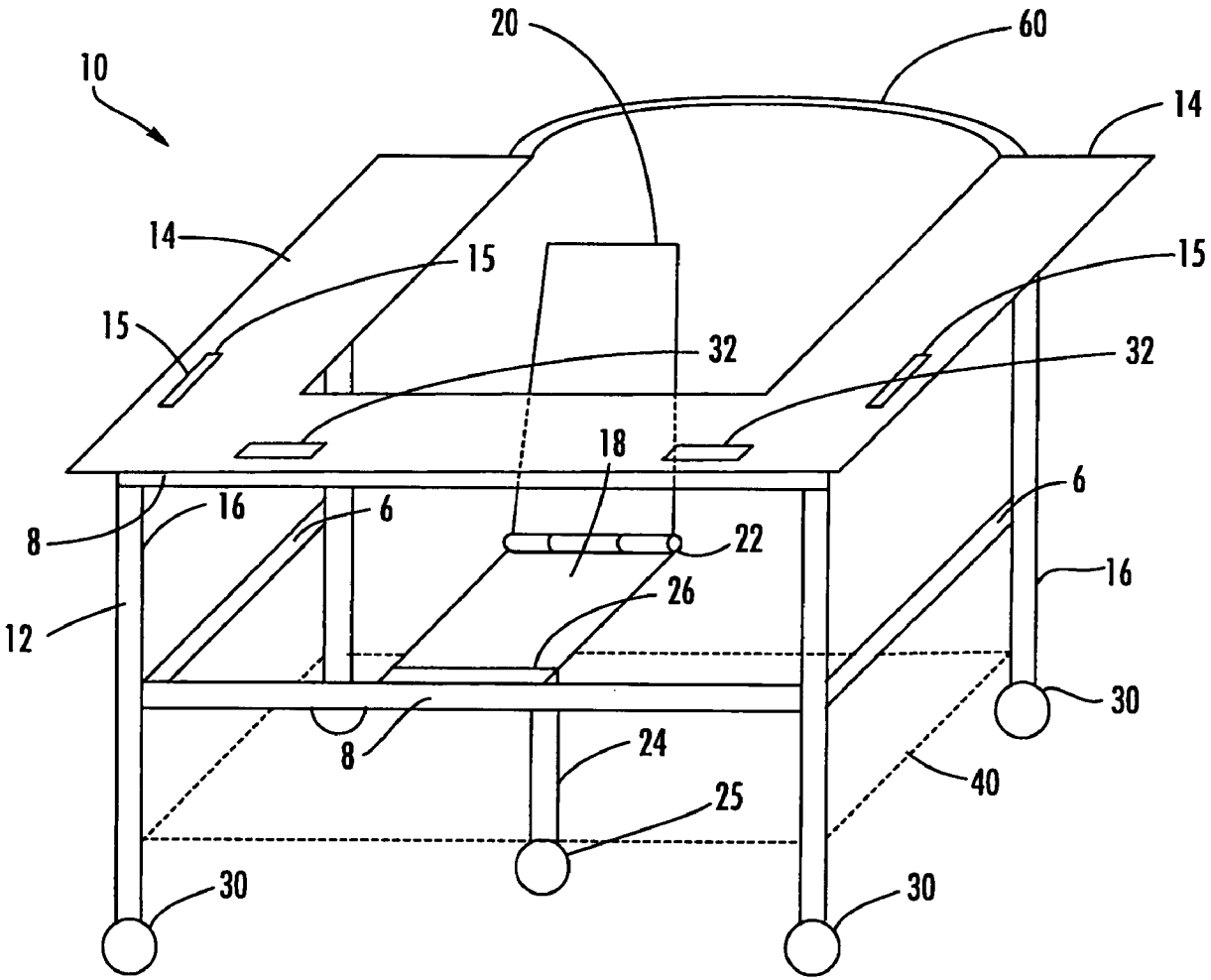
FIG. 1 is a diagrammatic perspective view of one exemplary embodiment of the glider-type transfer scooter of the present invention.
Figure 2:
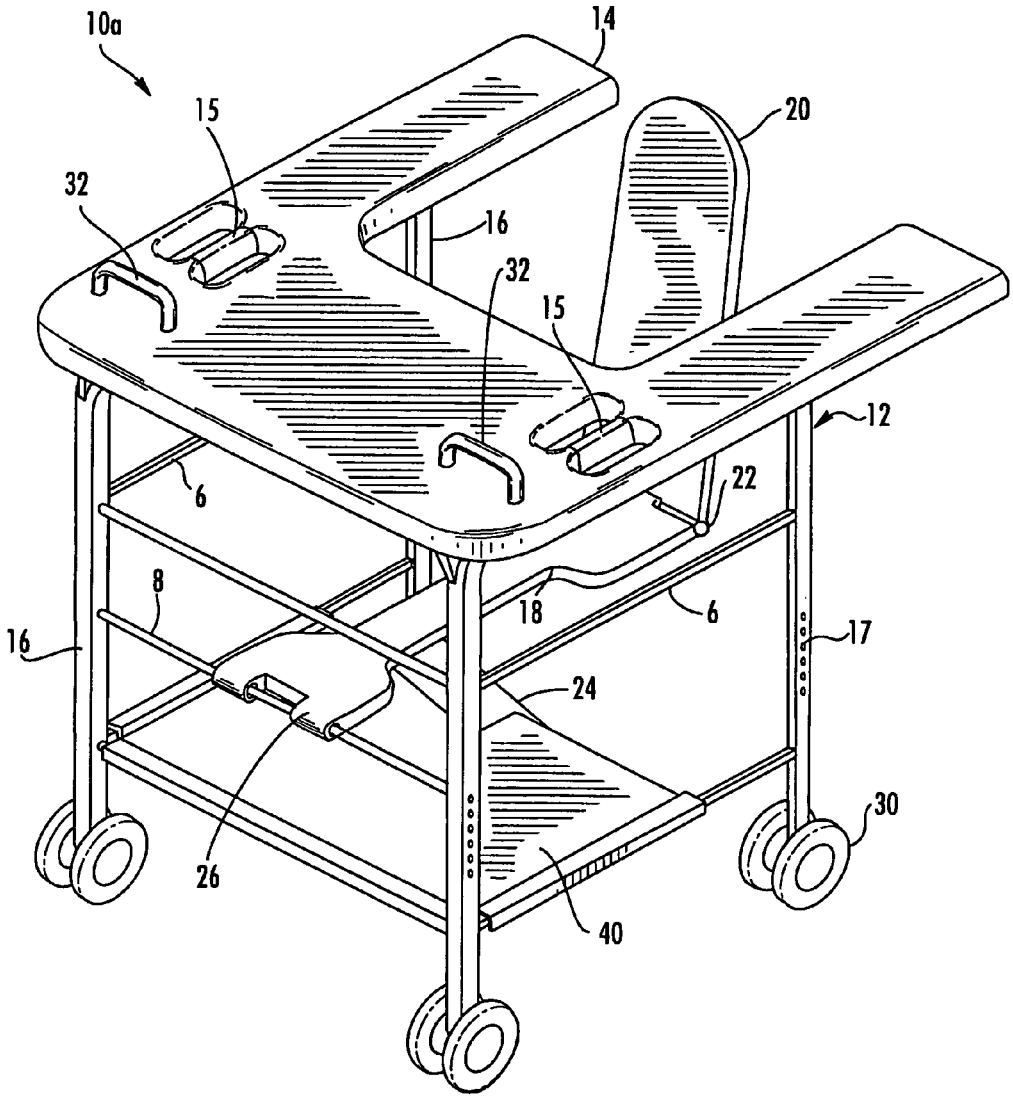
FIG. 2 is an elevational perspective view of the glider-type transfer scooter of FIG. 1.

Referring to FIG. 1, in one exemplary embodiment of the present invention, the glider-type transfer scooter 10 includes a plurality of legs 16 and support bars 6,8 that collectively form a frame 12 that is configured to support a padded armrest 14 or other tabletop-type attachment. A caster 30, wheel, or the like is attached to each of the legs 16, providing the glider-type transfer scooter 10 (and a user) with mobility. Preferably, the user is selectively seated in a seat 18 that has a deployable seat back 20, that, when fully reclined, dually serves as a ramp to facilitate sliding onto/off of the glider-type transfer scooter 10 from a bed, chair, or the like. The seat 18 is hingedly attached to the frame 12 via hinge 26 at the front support bar 8. An additional leg 24 terminated with an additional caster 25, wheel, or the like supports the seat 18. The leg can be angled backward so as to provide an overall wider base of support, or be substantially vertical to provide perpendicular support to the seat. Optionally, the seat 18 tapers in the middle or at one end, and/or incorporates sliding and/or extendable components, as well as the deployable seat back 20, that, when fully reclined, dually serves as a ramp to facilitate sliding onto/off of the glider-type transfer scooter 10 from a bed, chair, or the like. Furthermore, the seat and/or the deployable seat back member can be retractable, either translatable, for instance where 20 is inside 18, or in an overlapping configuration where 20 is under 18. As is evident from the Figures, the armrest 14 extends significantly beyond the frame 12, therein providing support for the user's arms, even when the user is positioned on the reclined deployable seat back. The armrest 14 can be padded, and it incorporates one or more handles 15 and one or more brake handles 32 for actuating one or more safety brakes associated with the casters 30, wheels, or the like. The one or more safety brakes associated with the casters 30, wheels, or the like are engaged by squeezing or releasing the one or more brake handles 32, etc. Optionally, the deployable seat back member 20 may have added support braces for the user's head, neck and torso, and the padded armrest 14 can also incorporate a safety strap 60 for selectively holding the user within the frame 12 and in the seat 18. As described above, the glider-type transfer scooter 10 provides the user with mobility and the seat 18 is disposed at a height such that the user may move onto/off of the seat from a bed, chair, or the like with ease and minimal effort on the part of a healthcare provider. To accomplish this goal, the height of the plurality of legs is preferably adjustable, for example, via a leg extension system 17, as illustrated in FIG. 2, or through mechanically assisted systems such as gas pistons, motorized telescoping assemblies, and other adjustable suspension devices. All of the supporting members of the glider-type transfer scooter 10 are made of metal or another rigid material that is suitable for supporting the weight of the user. The supporting members may be joined by welds, bolts, etc., and, where appropriate, hinges. Additionally, the glider-type transfer scooter 10 is sized such that it will comfortably accommodate the user. Optionally, the glider-type transfer scooter 10 also incorporates a hinged, non-hinged, or removable foot platform 40 for supporting the feet of the user while seated. The foot platform 40 can incorporate a heavy-duty rubber mat that can be selectively removed and used on the floor as a traction surface.

Figure 3:
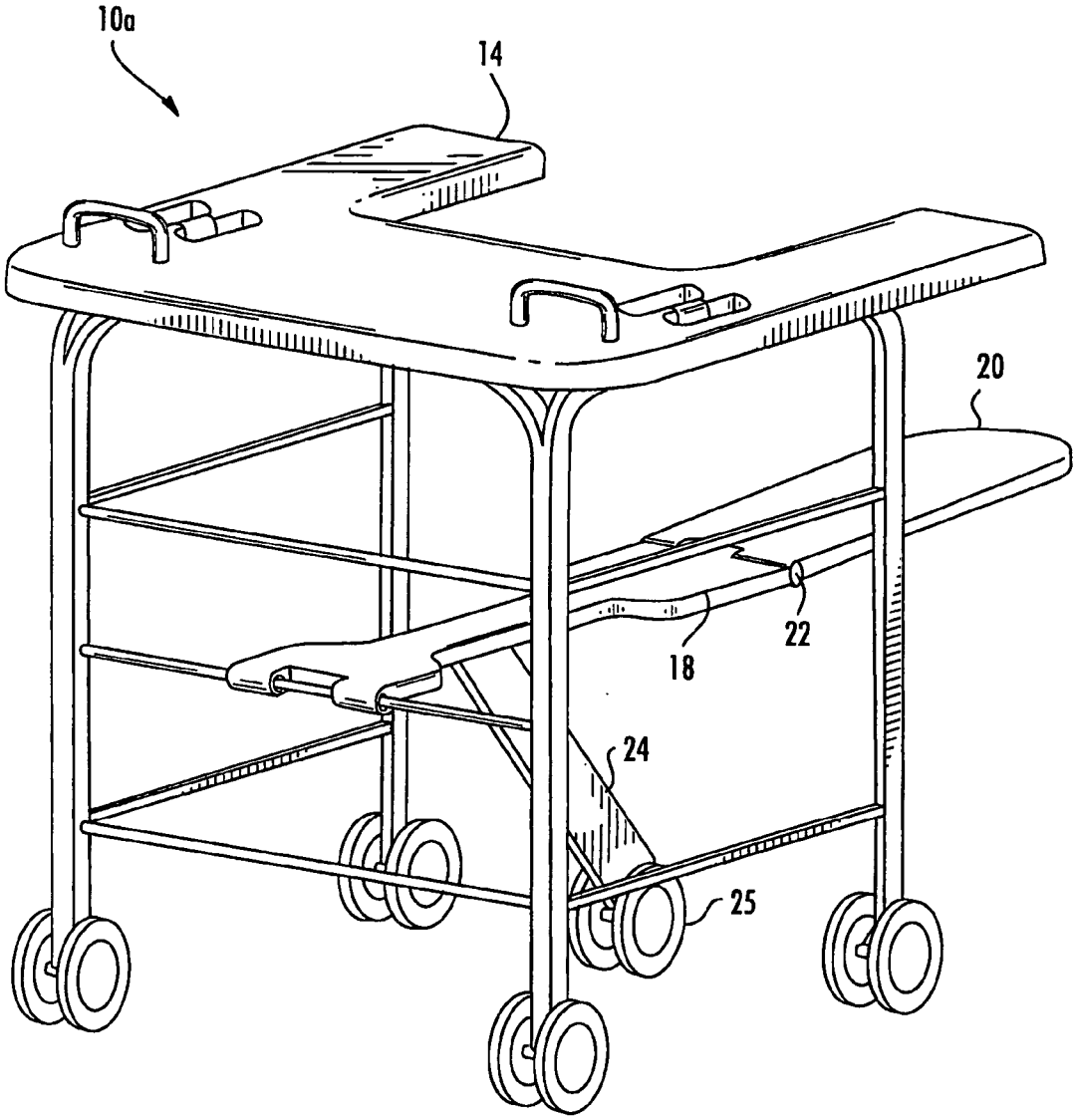
Figure 4:
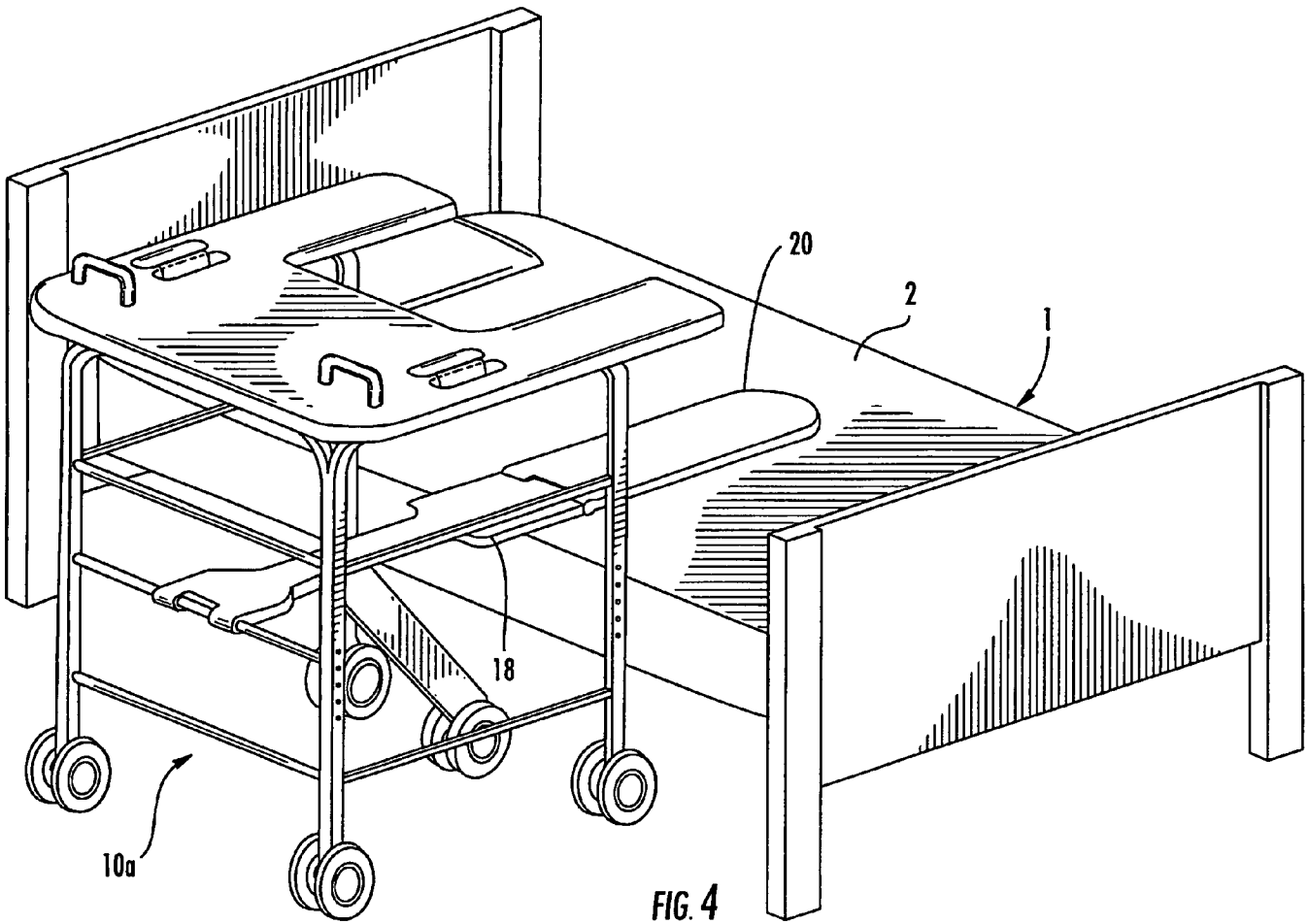
FIG. 4 is a perspective view of the glider-type transfer scooter of FIGS. 1-3, illustrating how the glider-type transfer scooter and a bed interface.

The transfer scooter is embodied in four versions that share the inventive elements of the transfer scooter. The variations are the glider-type scooter 10*a* (FIGS. 2-4), a walker-type transfer scooter 10*b* (FIGS. 5-7 and 10), and a motorized or non-motorized transfer scooter 10*c* (FIGS. 11-15). FIG. 2 is an elevational perspective view of the glider-type transfer scooter 10*a*. The glider-type transfer scooter 10*a* has a frame 12 with four legs 16 having an adjustable extension system 17 comprised of notches or holes with spring-loaded buttons or bolts for selectively setting the height. Other systems, such as threaded height adjustment systems, twist lock systems, and or through mechanically assisted systems, such as gas pistons, motorized telescoping assemblies, and other adjustable suspension devices could also be employed. It should be noted that, although the four legs 16 are illustrated in a substantially-vertical configuration, they may also be disposed at other angles, and in other numbers. For instance, the rear legs could be angled back to increase the area of the base of support, and to be partially positioned under a bed frame. The seat 18 is hinge-connected to front support bar 8. The deployable seat back 20 and the armrest 14 serve to enclose the user on the sides and the front and rear of the glider-type transfer scooter 10*a*. The seat back 20 can optionally also have torso, neck, and head supports. The armrest extends beyond the frame, therein providing arm support even when the user is positioned on the reclined deployable seat back. The armrest is removable, or as is shown in a later drawing, positioned on the front of the frame. In one embodiment, when the armrest is removed, the side of the frame can be rotated outward, therein enabling side access. The handles 15 are used principally when the user is standing, and the brake handles 32 enable the user to pull himself or herself forward, and to actuate safety brakes in the castors 30, wheels, or the like. Furthermore, the healthcare provider can use the handles to move the glider-type scooter away from a bed, etc., and to back the glider up to a chair or the like. The foot platform 40 provides a footrest for the user to elevate his/her feet, particularly for instance when they are being moved by a healthcare provider. In FIG. 3, the deployable seat back 20 is reclined toward and extends beyond an open side of the frame 12, so as to serve as a ramp for sliding onto/off of the glider-type transfer scooter 10*a*. In the illustrated embodiment, the angle of recline is limited by the end-to-end contact of the seat 18 and the back 20 at incline adjustment hinge 22, for example. However, as previously discussed in another embodiment the deployable seat back in the fully reclined position is also retractable, such that 20 is inside or under 18. The seat 18 and the deployable seat back 20 are substantially collinear in such a configuration. FIG. 4 illustrates how the glider-type transfer scooter 10*a* and a bed 1 interface. The seat 18 rests on the edge of the mattress 2, and the reclined deployable seat back 20 provides a ramp whereby the user, after raising him or herself to a substantially sitting position, can straddle the reclined deployable seat back 20 and slide onto the seat 18. The reclined deployable seat back 20 extends beyond the armrest, and the armrest extends beyond the frame. The seat 18 and the reclined deployable seat back 20 are at a height that is substantially the same as the upper surface of the mattress 2 of the bed 1. After securing the user with the armrest 14, the deployable seat back 20 is then raised to a comfortable inclined position. To disembark the glider-type transfer scooter 10*a* the process is substantially reversed.

Figure 5:
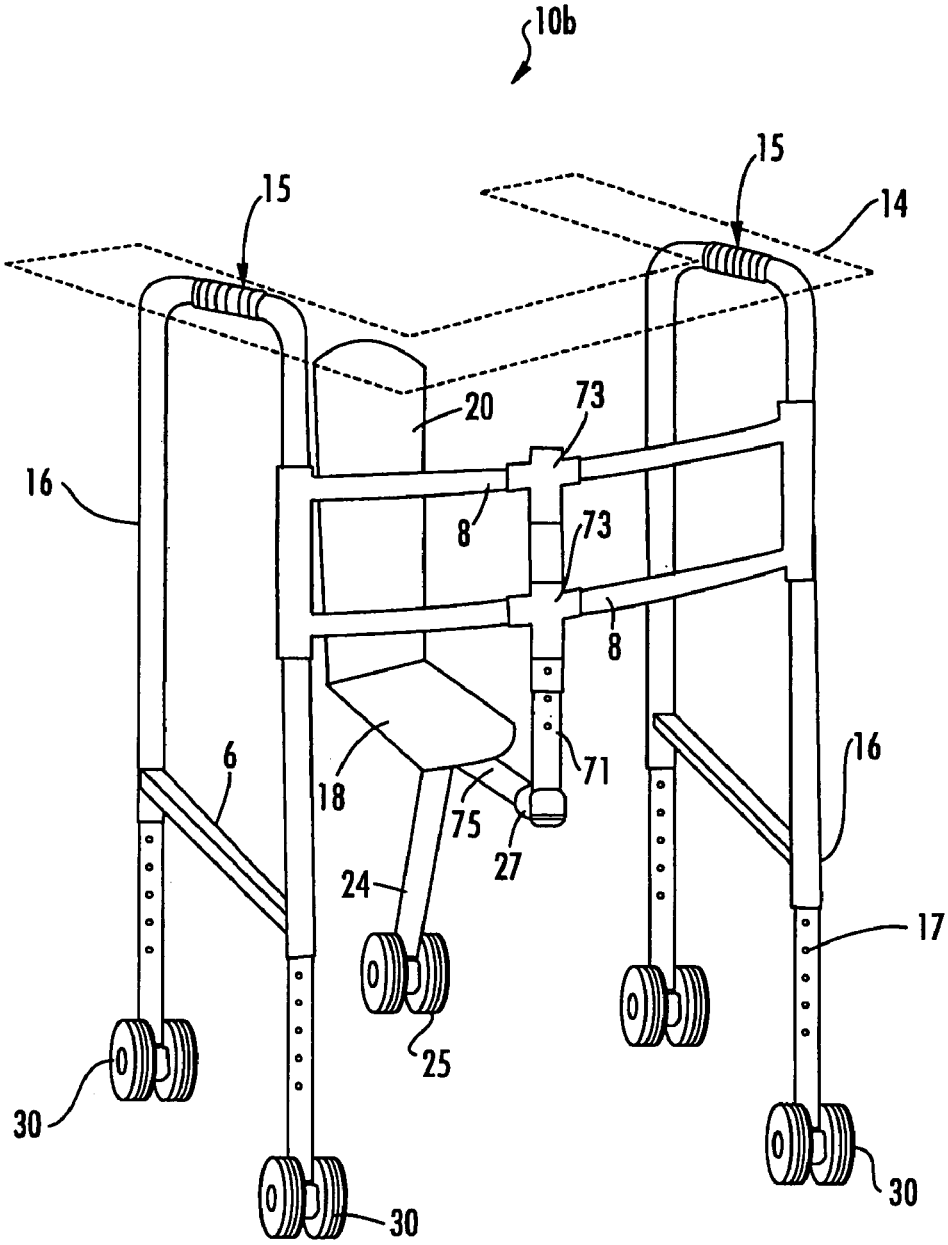
FIG. 5 is a perspective view of one exemplary embodiment of the walker-type transfer scooter of the present invention, wherein the armrest is shown in ghost.
Figure 6:
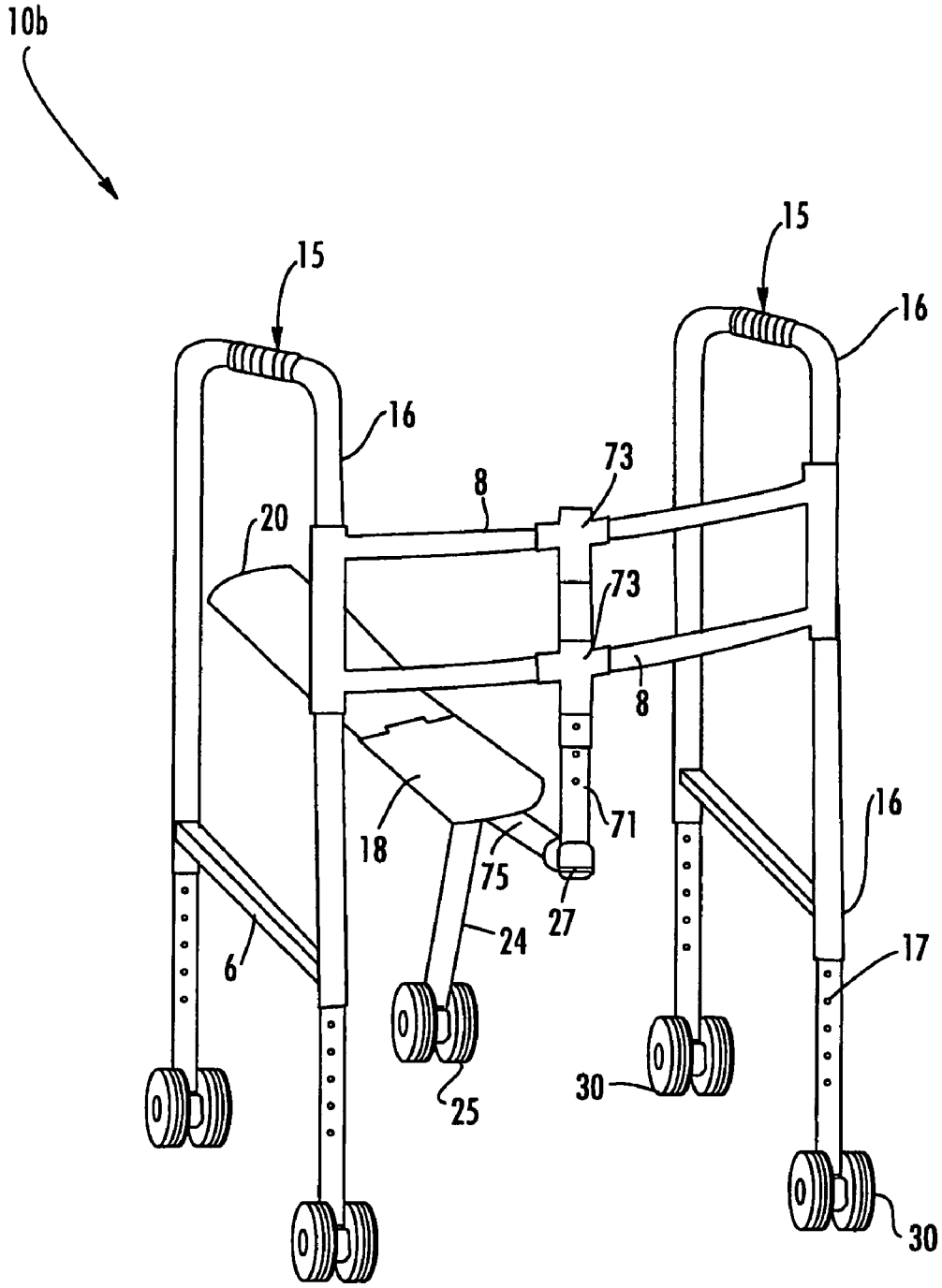
Figure 7:
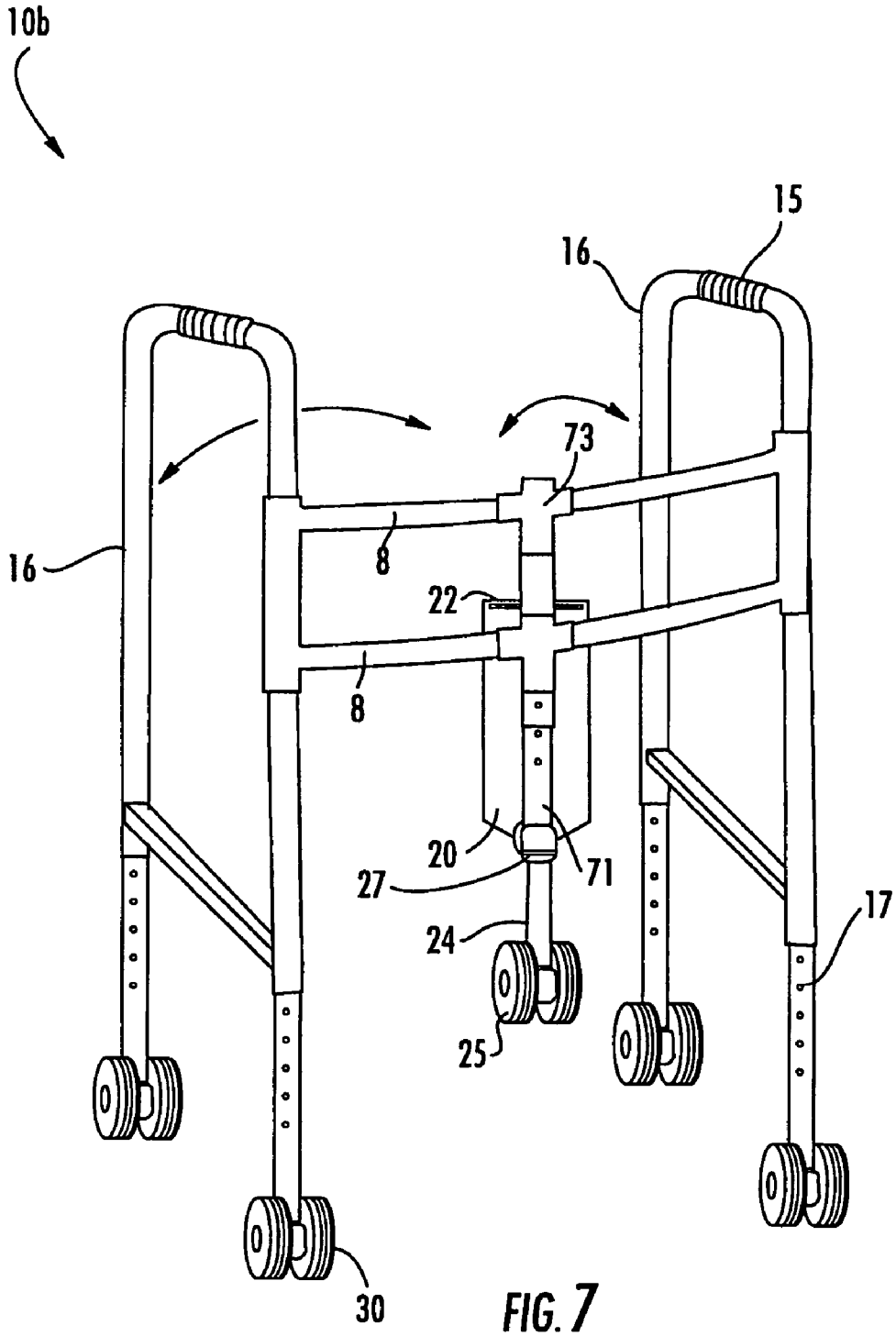
FIG. 7 is a perspective view of the walker-type transfer scooter of FIGS. 5 and 6, wherein the seat, the deployable seat back, and the associated frame member are collapsed.
Figure 19:
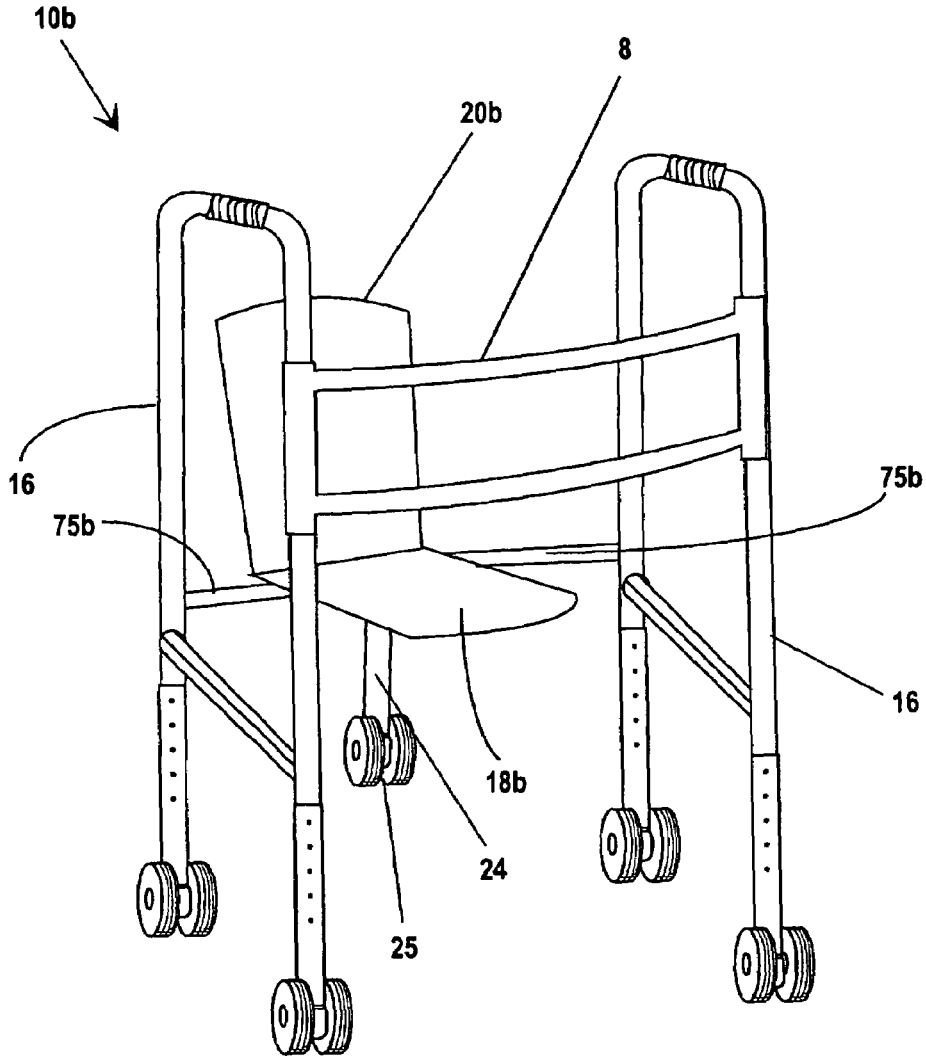
FIG. 19 is a perspective view of the walker-type transfer scooter, wherein the seat supported by the fifth wheel/caster and the like is reversibly attached to the rear legs of the scooter.

FIG. 5 is a perspective view of a walker-type transfer scooter 10*b*. The padded armrest 14 is shown in ghost, and is optional. The walker-type transfer scooter 10*b* meets the needs for a user who is generally stronger than those requiring the glider-type transfer scooter 10*a*, albeit substantially the same elements are present, but with somewhat greater freedom of movement and portability. The walker-type transfer scooter 10*b* enables a user to walk and then sit at his/her own pace, or to push along while sitting. As with the glider-type transfer scooter 10*a*, the walker-type transfer scooter 10*b* has a plurality of legs 16 and casters 30, wheels, or the like, and an additional leg 24 and an additional caster 25, wheel, or the like for supporting the seat 18. The top of the frame 12 can serve as an abbreviated armrest, when the padded armrest is removed. The frame 12 is preferably collapsible, in that the back legs 16 can be rotated inwardly, therein reducing the space needed to store the walker-type transfer scooter 10*b*. The walker-type transfer scooter 10*b* has a vertical support 71 that is hingedly connected to a horizontal support 75 via a hinge 26, which preferably is lockable. The vertical support 71 is attached to the front supports 8 with connecting member 73, which can be pipe coupling elements, welds, bolts, etc. The horizontal support 75 provides support for the seat 18, as does the additional leg 24 and caster 25, wheel, or the like. FIG. 6 is a perspective view of the walker-type transfer scooter 10*b* illustrated in FIG. 5, wherein the deployable seat back 20 is reclined, thereby being operable as a deployable ramp for moving to and from a bed, chair, or the like. FIG. 7 is a perspective view of the walker-type transfer scooter 10*b* collapsed to occupy less space. The deployable seat back 20 is folder forward flush against the top of the seat 18, pivoting at the incline adjustment hinge 22, and then the horizontal support 75 is pivoted upward, and the additional leg 24 is folded down. The rear legs 16 can then be rotated toward the centerline of the walker-type transfer scooter 10*b*. FIG. 19 is a variation of the walker-type transfer scooter 10*b*, wherein the seat 18*b* supported by the fifth wheel/caster and the like is reversibly coupled to the rear legs 16 via two horizontal supports 75*b*. The set of horizontal supports 75*b*, the seat 18*b*, the deployable seat back 20*b*, and the leg 24 with the caster 25 form an integral unit which can be coupled to the walker-type scooter 10*b* after the user is in position. The set of horizontal supports 75*b* make the frame non-collapsible.

Figure 8:
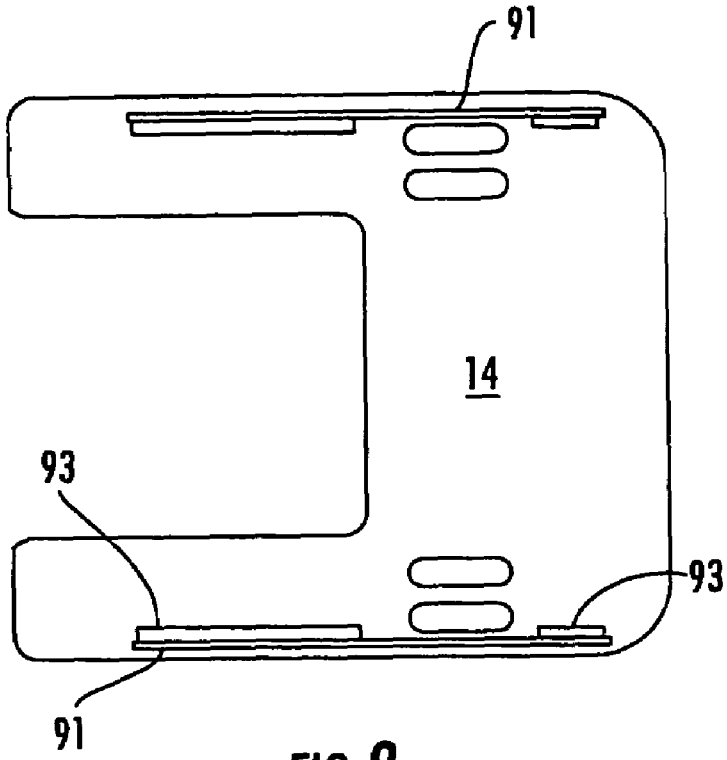
FIG. 8 is a planar view of the bottom of the armrest, illustrating a pair of elongate slotted mounting rails.
Figure 9:
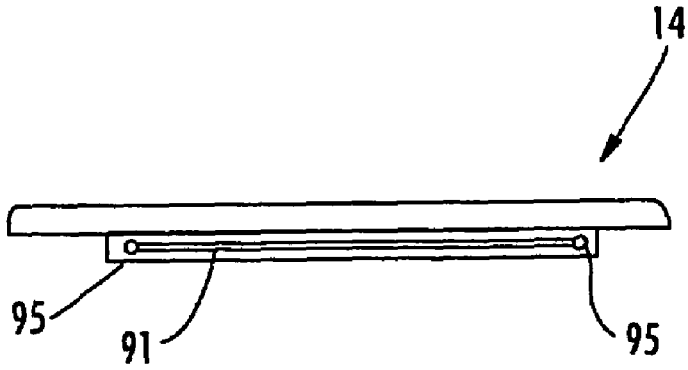
FIG. 9 is a planar view of the side of the armrest, illustrating one elongate slotted mounting rail.
Figure 10:
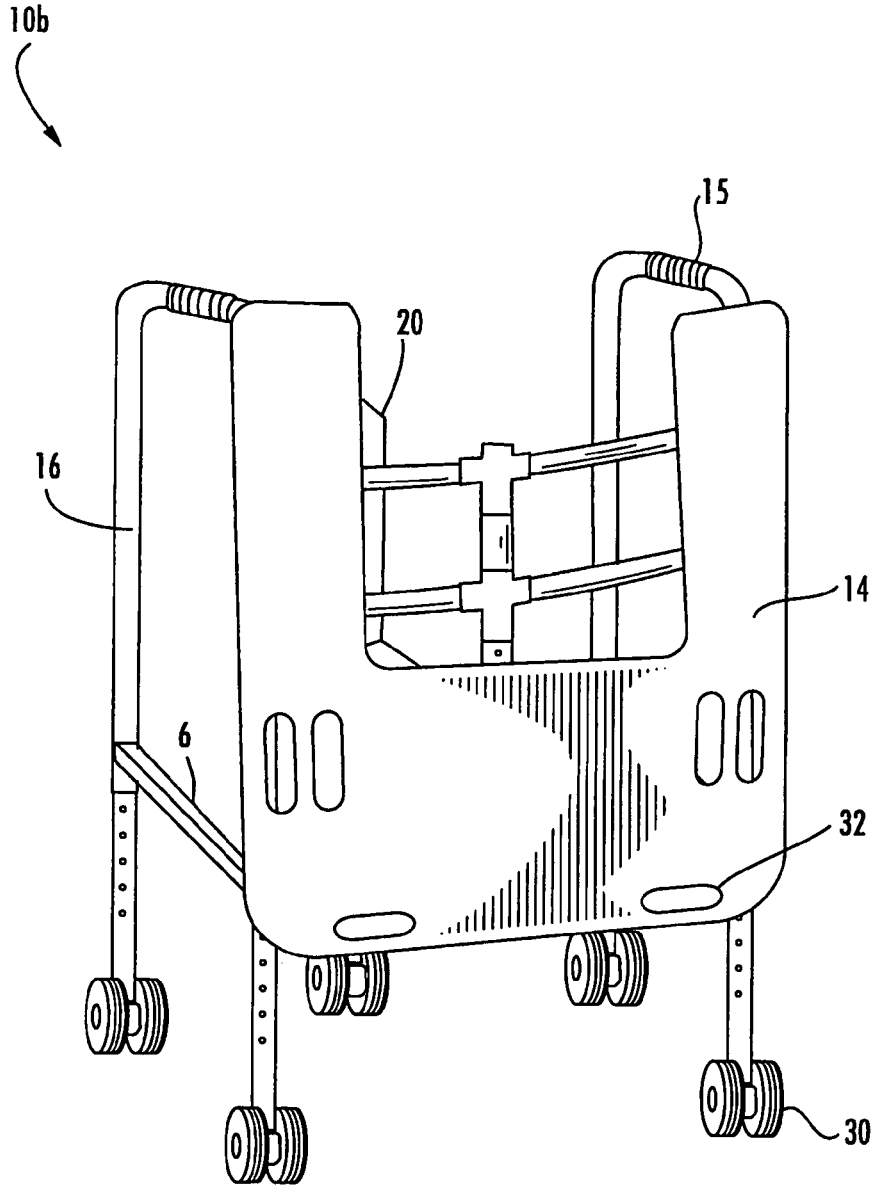
FIG. 10 is a perspective view of the walker-type transfer scooter of FIGS. 5-7, wherein the armrest has been deployed forward and rotated downward to the front of the walker-type transfer scooter.

FIG. 8 is a planar view of the bottom of the armrest 14. The bottom of the armrest 14 has a pair of elongate slotted mounting rails 91. The elongate slotted mounting rails 91 have angled sectional portions 93 which are attached to the bottom of the armrest 14, thereby stabilizing the elongate slotted mounting rails 91. The ends of the slots have enlarged circular openings that enable the armrest 14 to rotate on spring-loaded axial knobs and the like (not shown). The spring-loaded axial knobs enable the armrest 14 to be attached to the front or the top of the walker-type transfer scooter 10*b* and the glider-type transfer scooter 10*a*. FIG. 10 is a perspective view of the walker-type transfer scooter 10*b*, wherein the armrest 14 has been slid forward, and rotated downward to the front of the walker-type transfer scooter 10*b*. As is apparent, when mounted on top of the walker-type scooter the padded armrest extends beyond the frame, and the reclined deployable back seat member extends beyond the padded armrest.

Figure 11:
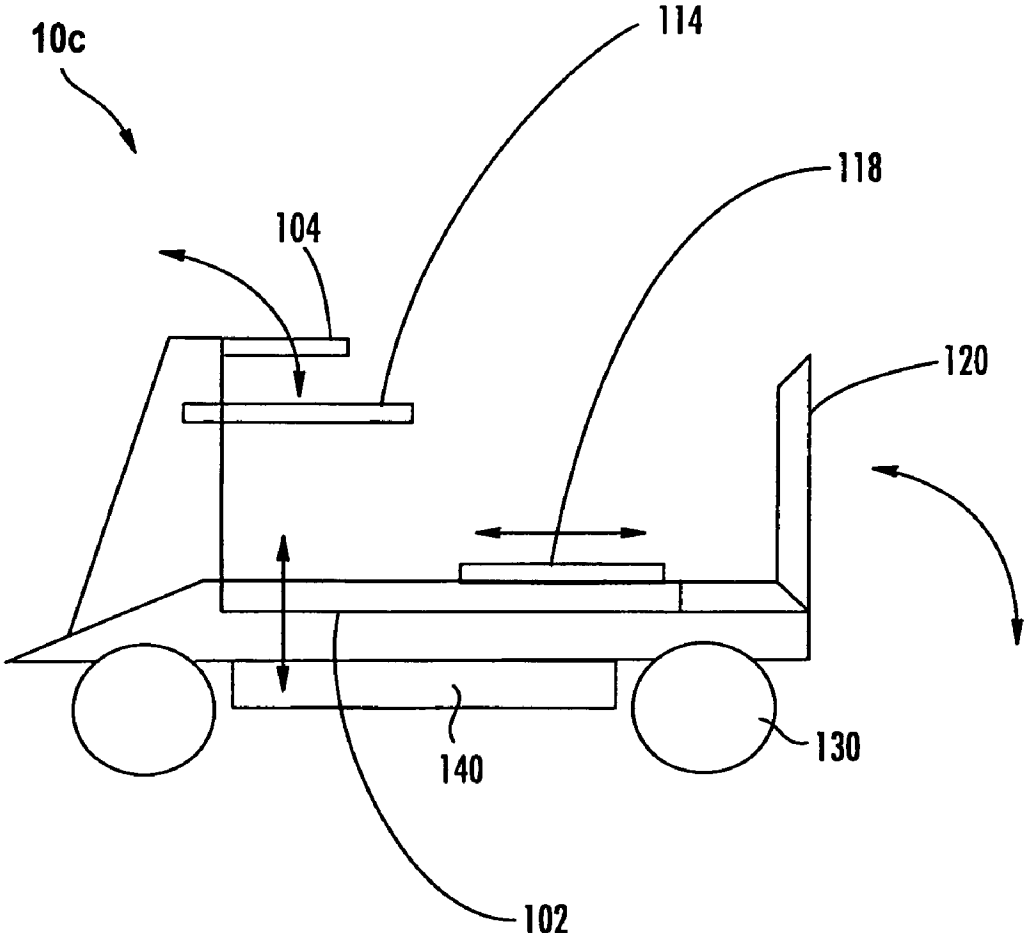
FIG. 11 is a diagrammatic side planar view of one exemplary embodiment of the motorized or non-motorized transfer scooter of the present invention.
Figure 12:
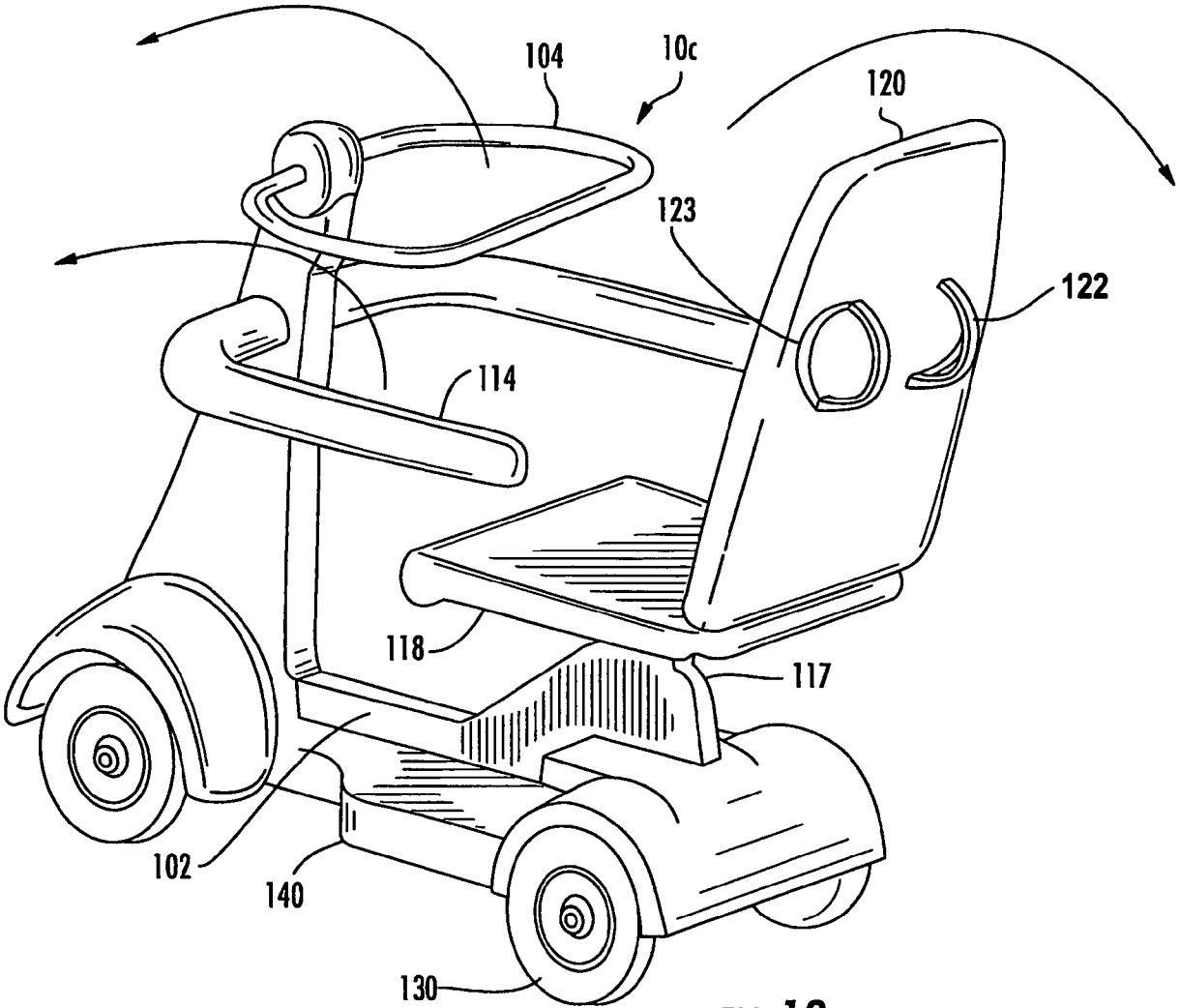
FIG. 12 is a perspective view of the motorized or non-motorized transfer scooter of FIG. 11, illustrating handles on the deployable seat back that enable the motorized or non-motorized transfer scooter to be pushed by a healthcare provider.
Figure 13:
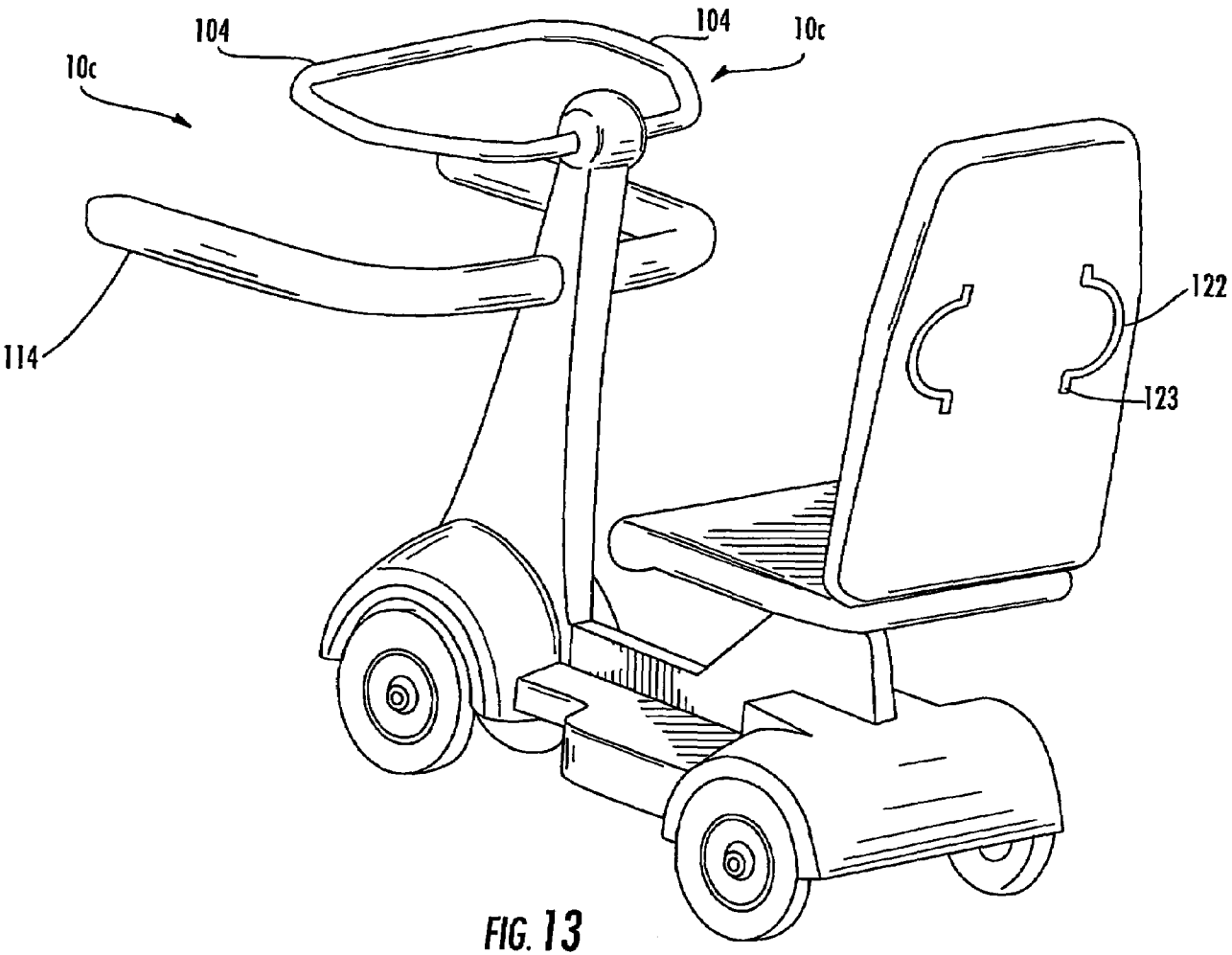
FIG. 13 is a perspective view of the motorized or non-motorized transfer scooter of FIGS. 11 and 12, illustrating that the steering handle bar and the armrest can be rotated to the front of the motorized or non-motorized transfer scooter so that the scooter can be pushed and/or steered by a healthcare provider.
Figure 14:
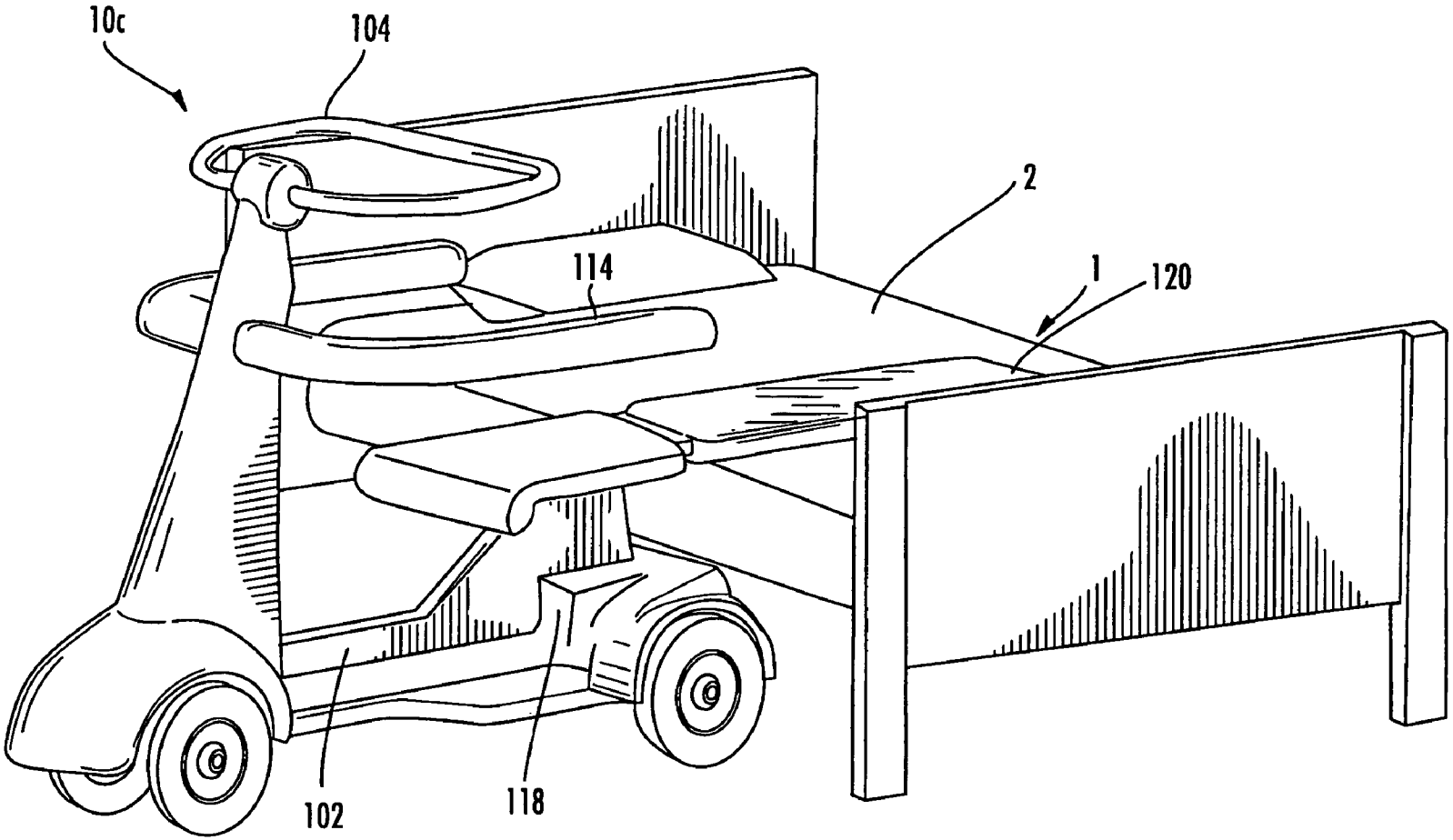
FIG. 14 is a perspective view of the motorized or non-motorized transfer scooter of FIGS. 11-13, wherein the deployable seat back is reclined, therein being operated as a ramp for moving to and from a bed.
Figure 15:
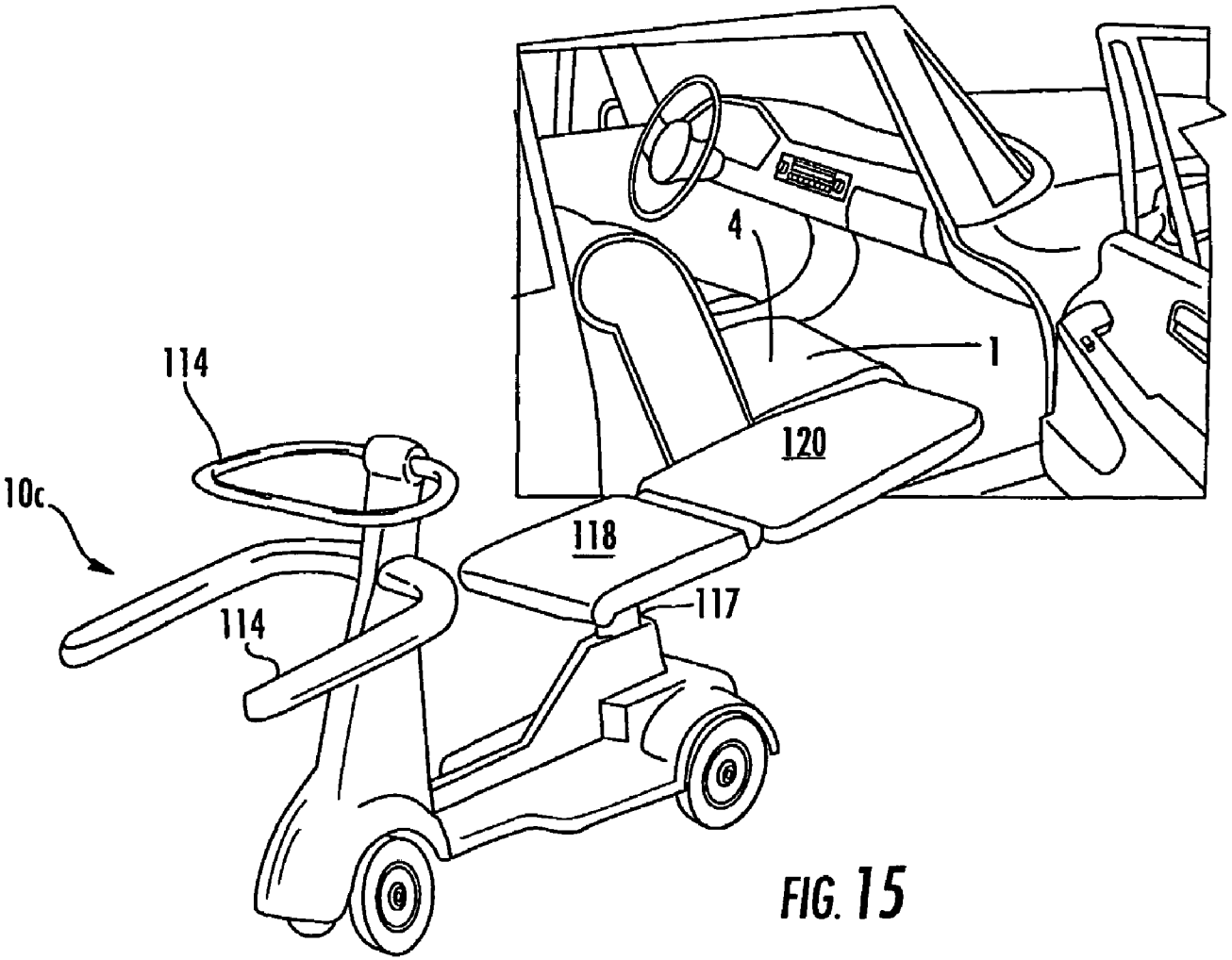
FIG. 15 is a perspective view of the motorized or non-motorized transfer scooter of FIGS. 11-14, wherein the deployable seat back is reclined, the steering handle bar and the armrest are rotated to the front of the motorized or non-motorized transfer scooter, and the motorized or non-motorized transfer scooter is positioned to load/unload a user onto/off of the motorized or non-motorized transfer scooter to/from the passenger compartment of a vehicle.

The motorized or non-motorized transfer scooter 10*c* is diagrammatically illustrated in FIG. 11. The motorized transfer or non-motorized transfer scooter 10*c* is a mobility assist device that provides a unique combination of mobility and assistance to a healthcare provider for selectively moving an individual under his or her care, as well as assisting the individual in moving himself or herself. Referring to FIG. 11, the motorized or non-motorized transfer scooter 10*c* is based on a platform that is well known to those of ordinary skill in the art, incorporating three or four wheels, a steering and braking mechanism, a heavy-duty battery, and a heavy-duty motor (in the motorized configuration). However, the motorized or non-motorized transfer scooter 10*c* loads/unloads in a manner similar to a jet ski or the like, i.e. from the rear. It is unlike other scooters in that it has a translatable seat 118 that is attached to a height-adjustable sliding track 102, thereby allowing the translatable seat 118 to move from a first loading/unloading position to a second operating position. This height-adjustable sliding track 102 may run the length of the body of the motorized or non-motorized transfer scooter 10*c* and, optionally, the length of the deployable ramp 120. Furthermore, the motorized or non-motorized transfer scooter 10*c* has an adjustable seat back 120 that can recline to where it is substantially collinear with the translatable seat 118, thereby providing the deployable ramp 120. The translatable seat 118, as well as the height-adjustable sliding track 102, may be motorized or hand-operated. The motorized or non-motorized transfer scooter 10*c* has a stowable armrest 114 that can rotate forward, a footrest platform 140, and stowable handles 104 that provide a means of steering the motorized or non-motorized transfer scooter 10c. As will become apparent from the Figures, the deployable ramp 120 is a novel technique for loading/unloading. Additionally, the armrest 114 enables the motorized or non-motorized transfer scooter 10*c* to be used to safely and easily load/unload a user onto/off of the motorized or non-motorized transfer scooter 10*c* to/from virtually any vehicle, as well as a bed or a wheelchair. FIG. 12 is a perspective view of the motorized or non-motorized transfer scooter 10*c* of the present invention illustrating that the motorized or non-motorized transfer scooter 10*c* can also have push handles 122 on the adjustable seat back 120 that enable the motorized or non-motorized transfer scooter 10*c* to be pushed by a healthcare provider. The adjustable seat back 120 has recesses 123 for folding in push handles 122, thereby providing a flat profile. These push handles 122 can have a substantially-horizontal configuration or a substantially-vertical configuration, comprise multiple single handles, or comprise a single unified bar or the like. The translatable seat is adjusted by a slide 117, and the vertical position of the seat by the height adjustable sliding track 102. In the illustrated embodiment the motorized or non-motorized transfer scooter has four wheels 130. FIG. 13 is a perspective view of the motorized or non-motorized transfer scooter 10*c* illustrating the steering handle bar 104 and the armrest 114 rotated to the front of the motorized or non-motorized transfer scooter 10*c* so that the motorized or non-motorized transfer scooter 10*c* can be steered by a healthcare provider. The push handles 122 are folded into the recesses 123. FIG. 14 is a perspective view of the motorized or non-motorized transfer scooter 10*c*, wherein the adjustable seat back 120 is reclined, thereby being operable as a ramp for moving to/from a bed 1. The translatable seat 118 is moved back and adjusted in height so that the deployable ramp 120 is substantially flush with the top of the mattress 2. FIG. 15 illustrates the motorized or non-motorized transfer scooter 10*c* positioned adjacent to a vehicle seat 4, wherein the motorized or non-motorized transfer scooter 10*c* is selectively positioned adjacent to and partially within the vehicle. The translatable seat 118 is moved back and the height adjustable track is adjusted in height so that the deployable ramp 120 is substantially contiguous with the vehicle seat 4.

Figure 16:
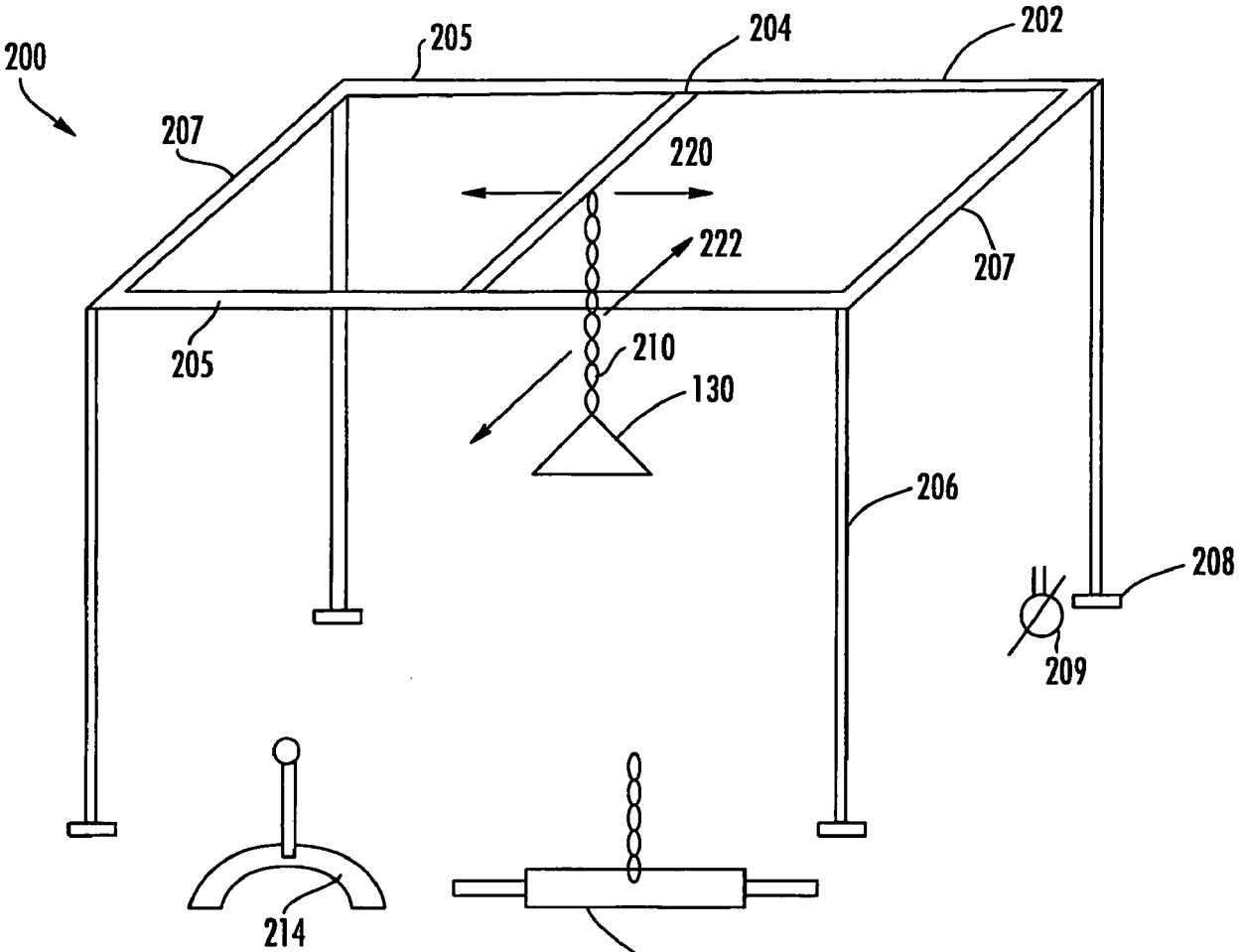
FIG. 16 is a diagrammatic perspective view of one exemplary embodiment of the lift system of the present invention.

FIG. 16 is a perspective view of one exemplary embodiment of the lift system 200 of the present invention. Referring to FIG. 16, the lift system 200 includes a plurality of legs 206 and support beams 205,207 which form a frame 202. The plurality of legs 206 and support beams 205,207 are made of metal or another rigid material that is suitable for supporting the weight of a user. The plurality of legs 206 and support beams 205,207 are joined by welds, bolts, etc. Preferably, the lift system 200 is disposed over a bed or the like of a user, providing the user with a handle 130 or the like, connected to a transfer bar 204 via a line 210, to grab and lift himself or herself. The handle 130 or the like, is itself translatable in two directions 220,222 via a track associated with a transfer bar 204. The transfer bar 204 provides the user with mobility and aids a healthcare provider in moving the user into/out of his or her bed or the like (possibly into/out of the transfer scooter 10 described above). Preferably, a non-slip foot pad 208 or a lockable caster 209, wheel, or the like is attached to each of the plurality of legs 206, allowing the frame 202 to be selectively moved. Optionally, the handle 130 described above is replaced with a padded armrest assembly 214, an underarm strap 232 that is securable using Velcro or the like, etc. The lift system 200 is sized such that it will comfortably accommodate the bed or the like of the user.

Figure 17:
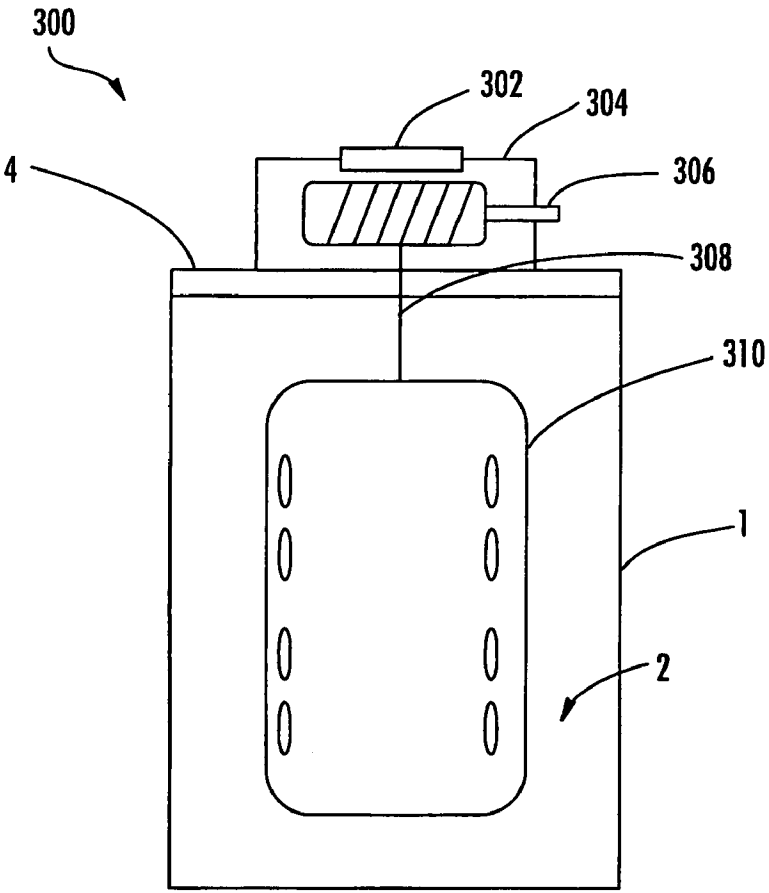
FIG. 17 is a diagrammatic top planar view of one exemplary embodiment of the pull-up assembly of the present invention.

FIG. 17 is a top planar view of one exemplary embodiment of the pull-up assembly 300 of the present invention. Referring to FIG. 17, the pull-up assembly 300 includes a motorized or hand-operated winch 304 or the like, well known to those of ordinary skill in the art, that is selectively attached to a bed rail 4 associated with a bed 1 or the like of a user. The winch 304 or the like incorporates a handle 302, allowing it to be easily transported from location to location. The winch 304 or the like is selectively attached to a low-friction transfer board 310 via a transfer line 308. The low-friction transfer board 310 may be made of wood, a plastic, or any other suitable low-friction material and may have any suitable dimensions. In operation, while reclined in bed 1 or the like, the user is log-rolled by a healthcare provider and the low-friction transfer board 310 is placed under the user's back. The user is then log-rolled again, back onto the low-friction transfer board 310. The transfer line 308 is attached to the low-friction transfer board 310 and the winch 304 or the like is activated, pulling the low-friction transfer board 310, and the user, up in the bed or the like. The log-rolling process is then reversed to remove the low-friction transfer board 310. Thus, the user is safely and easily repositioned in the bed or the like, with minimal exertion on the part of the healthcare provider.

Figure 18:
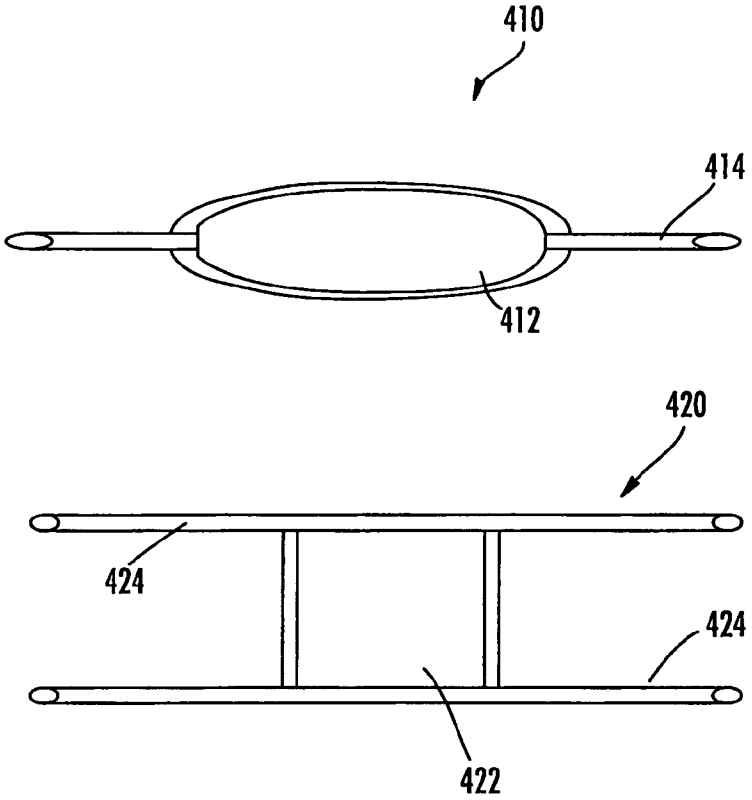
FIG. 18 is a diagrammatic front/top planar view of two exemplary embodiments of the mobility assist strap of the present invention.
Figure 18:
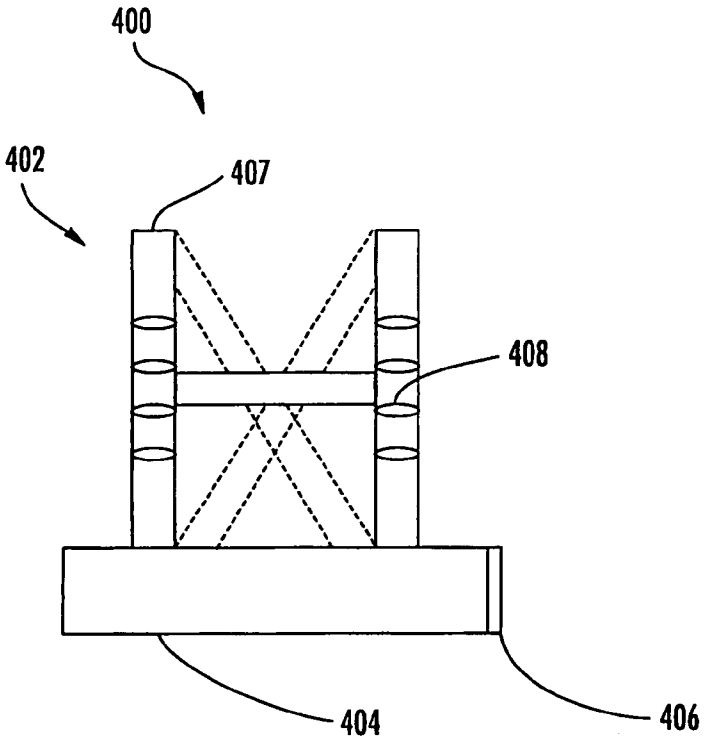

FIG. 18 is a front/top planar view of exemplary embodiments of the mobility assist strap 400 of the present invention. Referring to FIG. 18, a plurality of mobility assist straps 400 are illustrated. These mobility assist straps 400 are used by one or more persons to safely and easily move heavy objects. A harness 402 is comprised of padded shoulder straps 407 and a back brace 404 with hook and loop fasteners 406. The harness 402 has quick release attachment points 408 for easy adjustment. The harness 402 is preferably made of nylon or the like. A one-user strap assembly 410 has a pair of straps that intersect an elliptical object holder 412. A two-user strap assembly 420 is also illustrated. Parallel straps 424 support cross elements of an object holder 422.

Although the present invention has been illustrated and described herein with reference to preferred embodiments and examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A mobility assist device for moving an individual with limited mobility, or allowing such an individual to move himself or herself, comprising:

a substantially-rigid frame having sufficient strength to support the weight of the individual;

a seat member attached to the substantially-rigid frame, wherein the seat member comprises a seat bottom member and a deployable seat back member that is selectively adjustable from at least a first upright position to a second reclined position, wherein in the second reclined position, the seat bottom member, and the deployable seat back member are substantially collinear, thereby functioning as a ramp that facilitates loading/unloading of the individual into/out of the seat member and the mobility assist device, and a single armrest engaged to and substantially conforming to the upper portion of the substantially-rigid frame and substantially covering the entire upper portion of the substantially-rigid frame, wherein the single armrest is selectively adjustable from at least a first usable position on the top of the substantially-rigid frame to a second stowed position on the front of the substantially-rigid frame.

2. The mobility assist device of claim 1, further comprising a plurality of coasters attached to the substantially-rigid frame.

3. The mobility assist device of claim 1, wherein the seat member is removably or hingedly attached to the substantially-rigid frame.

4. The mobility assist device of claim 1, wherein the deployable seat back member is hingedly attached to the seat bottom member.

5. The mobility assist device of claim 1, further comprising a leg member and an additional rolling member attached to the seat member, wherein the leg member has sufficient strength to support the weight of the individual.

6. The mobility assist device of claim 5, wherein the leg member is hingedly attached to the seat member.

7. The mobility assist device of claim 1, further comprising one or more foot rest members selectively attached to the substantially-rigid frame.

8. The mobility assist device of claim 2, further comprising one or more lock/brake actuators for selectively locking/braking the plurality of coasters.

9. The mobility assist device of claim 1, wherein the height of the substantially-rigid frame is selectively adjustable.

10. A mobility assist device for moving an individual with limited mobility, or allowing such an individual to move himself or herself, comprising:

a substantially-rigid body assembly having sufficient strength to support the weight of the individual, wherein the substantially-rigid body assembly is one of motorized and non-motorized;

a plurality of coasters attached to the substantially-rigid body assembly;

a seat member attached to the substantially-rigid body assembly, wherein the seat member comprises a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device;

a single armrest engaged to the upper portion of the substantially-rigid body assembly and substantially covering the entire upper portion of the substantially-rigid body assembly, wherein the single armrest is selectively adjustable from at least a first usable position on the top of the substantially-rigid body assembly to a second stowed position on the front of the substantially-rigid body assembly; and the single armrest having at least one handle for allowing the individual to grasp the handle to facilitate loading/unloading of the individual.

11. The mobility assist device of claim 8, wherein the seat member is translatable relative to the substantially-rigid body assembly.

12. The mobility assist device of claim 8, wherein the deployable seat back member is hingedly attached to the seat bottom member.

13. The mobility assist device of claim 8, wherein the height of the seat member is selectively adjustable.

14. A mobility assist device for moving an individual with limited mobility, or allowing such an individual to move himself or herself, comprising:

a substantially-rigid body assembly having sufficient strength to support the weight of the individual, wherein the substantially-rigid body assembly is one of motorized and non-motorized;

a plurality of lockable coasters attached to the substantially-rigid body assembly;

a translatable seat member attached to the substantially-rigid body assembly, wherein the translatable seat member comprises a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device;

a single armrest engaged to the upper portion of the substantially-rigid body assembly and substantially covering the entire upper portion of the substantially-rigid body assembly, wherein the single armrest is selectively adjustable from at least a first usable position on the top of the substantially-rigid body assembly to a second stowed position on the front of the substantially-rigid body assembly; and the single armrest having at least one brake handle positioned on the single armrest for controlling the movement of the coasters.

15. The mobility assist device of claim 12, wherein the seat bottom member is translatable relative to the deployable seat back member and the substantially-rigid body assembly.

16. The mobility assist device of claim 12, wherein the deployable seat back member is hingedly attached to the substantially-rigid body assembly.

17. The mobility assist device of claim 12, wherein the height of the seat member is selectively adjustable.

18. The mobility assist device of claim 1, wherein said armrest and reclined deployable seat back member extend beyond the frame, therein providing arm support when the user is positioned on the deployable seat back member which is in the second reclined position.

19. The mobility assist device of claim 8, wherein said armrest and reclined deployable seat back member extend beyond the frame, therein providing arm support when the user is positioned on the deployable seat back member which is in the second reclined position.

20. The mobility assist device of claim 12, wherein said armrest and reclined deployable seat back member extend beyond the frame, therein providing arm support when the user is positioned on the deployable seat back member which is in the second reclined position.

21. The mobility assist device of claim 14, wherein said reclined deployable seat back member extends beyond the armrest.

22. The mobility assist device of claim 15, wherein said reclined deployable seat back member extends beyond the armrest.

23. The mobility assist device of claim 16, wherein said reclined deployable seat back member extends beyond the armrest.

24. A mobility assist device for moving an individual with limited mobility, or allowing such an individual to move himself or herself, comprising:

a substantially-rigid body assembly having sufficient strength to support the weight of the individual;

a plurality of coasters attached to the substantially-rigid body assembly;

a seat member, wherein the seat member comprises a seat bottom member and a deployable seat back member that is selectively adjustable from at least a first upright position to a second reclined position, wherein in the second reclined position the seat bottom member and the deployable seat back member are substantially collinear, thereby functioning as a ramp that facilitates loading/unloading of the individual into/out of the seat member and the mobility assist device;

a set of horizontal supports that can be coupled to the rear of the assembly, where the set of horizontal supports, the seat member, the deployable seat back, and a rolling member are an integral unit which can be coupled to the assembly after the individual is in the mobility assist device;

a single armrest engaged to the upper portion of the rigid frame and substantially covering the entire rigid frame;

the armrest having at least one handle for allowing the individual to grasp the handle to facilitate loading/unloading of the individual; and the armrest having at least one brake handle positioned on the armrest for controlling the movement of the coasters.

* * * * *